United States Patent [19]

Shaffer

[11] Patent Number: 4,519,785

[45] Date of Patent: May 28, 1985

[54] LIFE TUNGSTEN FILAMENT FOR INCANDESCENT LAMP

[75] Inventor: John W. Shaffer, Williamsport, Pa.

[73] Assignee: GTE Products Corporation, Stamford, Conn.

[21] Appl. No.: 667,407

[22] Filed: Nov. 5, 1984

Related U.S. Application Data

[63] Continuation-in-part of Ser. No. 580,273, Feb. 16, 1984, abandoned, which is a continuation of Ser. No. 368,543, Apr. 15, 1982, abandoned.

[51] Int. Cl.[3] ..... H01J 9/12

[52] U.S. Cl. ..... 445/48; 427/52; 427/111

[58] Field of Search ..... 445/48; 427/52, 111

[56] References Cited

U.S. PATENT DOCUMENTS

| | | | |
|---|---|---|---|
| 699,232 | 5/1902 | Potter | 427/52 |
| 3,811,936 | 5/1974 | Archer et al. | 427/52 |
| 4,374,901 | 2/1983 | Ferrar | 427/52 X |

*Primary Examiner*—Kenneth J. Ramsey

*Attorney, Agent, or Firm*—Carlo S. Bessone; William H. McNeill

[57] ABSTRACT

A method for increasing the life and stability of tungsten filaments by burning the filaments in an atmosphere containing $WF_6$. The procedure effects hot spot repair of the filaments by localized deposition of tungsten thereon.

6 Claims, No Drawings

LIFE TUNGSTEN FILAMENT FOR INCANDESCENT LAMP

This is a continuation-in-part of application Ser. No. 580,273, filed 2/16/84, and now abandoned, which is a continuation of Ser. No. 368,543 filed 4/15/82, now abandoned.

TECHNICAL FIELD

This invention relates to incandescent lamps and more particularly to the filaments thereof. Still more particularly, it relates to a method for increasing the life of such filaments when such filaments are constructed from tungsten.

BACKGROUND OF THE INVENTION

The use of tungsten filaments in incandescent lamps is well established. Also well established is the fact that tungsten filaments do not heat to a uniform temperature upon passage of an electric current therethrough. Rather, localized hot spots are generally observed. Such hot spots are the filament life-determining factor in a well-made lamp because of their higher rate of tungsten evaporation. A runaway condition thereby exists, with evaporation-promoted thinning of the wire and consequent increased ohmic heating and ever higher localized temperatures.

Hot spots on a filament may arise because of nonuniform wire cross sectional area, nonuniform cross sectional shape, variations in wire surface smoothness, nonuniformly spaced turns or segments of turns in a coiled or coiled coil geometry, and other reasons. The subsequent coiling and bending processes used in the forming operations, causes abrasions, cracks and splits in the filament which further contribute to the occurrence of hot spots. While good lamp manufacturing practice strives to reduce all such contributing factors, the presence of hot spots is nevertheless ubiquitous.

It is well known to those skilled in the art that a halogen cycle based on flourine or its compounds differs from those based on bromine and the other halogens in that with fluorine evaporated tungsten is redeposited back onto the filament in a rate that increases with filament temperature. This is because of the relatively greater thermal stability of tungsten fluoride as compared to the other tungsten halides. In effect, the fluorine cycle renders the filament much more stable because the hot spots, which are more prone to evaporation, are also significantly more effective in thermally breaking down tungsten fluoride and thereby depositing tungsten back onto the filament. If practice, it is found that, at hot spots, tungsten deposition occurs at a higher rate than does evaporation, and the net effect is for a fluorine-cycle lamp to continually repair its filament.

The attractiveness of the fluorine cycle in incandescent lamps is somewhat offset by the toxicity of fluorine compounds (either initially or after operation of the lamp) and the technical difficulty of providing a lamp vessel and lead wires that are resistant to fluorine attack. U.S. Pat. No. 4,256,988, e.g., addresses the problems of how to protect a lamp envelope and the filament supporting structure from attack by fluorine in a tungsten-fluorine lamp. The suggested method involves coating the interior of the lamp envelope and the internal structure with fluorine resistant compounds.

While this approach is interesting, it would certainly be expensive; and, it does not solve the problems occasioned by leaving in the hands of consumers a vessel loaded with toxic fluorine or fluoride compounds.

DISCLOSURE OF THE INVENTION

It is, therefore, an object of the invention to obviate the disadvantages of the prior art.

It is another object of the invention to enhance the life of tungsten filaments.

These objects are accomplished, in one aspect of the invention, by the provision of a method for increasing the life of tungsten filaments. The method comprises the steps of forming a tungsten filament and then burning the filament in a tungsten fluoride containing atmosphere to substantially remove hot spots. The filament is subsequently assembled into a lamp vessel or envelope having an atmosphere that does not contain fluorine.

This process allows the use of the advantageous fluorine regenerative cycle under closely controlled manufacturing conditions while keeping the ultimate lamp delivered to the general public fluorine-free.

BEST MODE FOR CARRYING OUT THE INVENTION

For a better understanding of the present invention, together with other and further objects, advantages and capabilities thereof, reference is made to the following disclosure and appended claims.

The method is accomplished by first forming a filament from a length of tungsten wire. The filament can remain as cut; or it can be formd into a coil; a coiled coil; or any other desired configuration. The filament can be mounted on lamp leads or support wires. The filament is then placed in closed environment which can be the final lamp vessel but preferably is a separate chamber formed of monel or other suitable fluorine resistant material.

The closed environment is then provided with a non-hydrogen containing gas fill which includes tungsten fluoride ($WF_6$). Electrical energy is then applied to the filament to cause the hot spots on the filament to incandesce. Metal deposition is desired only in areas where hot spots occur along the filament and is accomplished by regulating the electrical energy so as to heat those areas to a significantly higher temperature (i.e., incandesce) then the remainder of the filament. This may be accomplished, for example, by passage of relatively high current, intermittent pulses through the filament of sufficiently brief duration that only the localized damaged areas incandesce. The time and operating conditions should be sufficient to also substantial repair of hot spots, wherever located or regardless of cause. This fluorine treatment, as noted above, renders the filament more stable.

After the treatment the filament is removed from the closed environment and subsequently is assembled into a lamp. The treated filament is effective in vacuum incandescent lamps, inert gas filled incandescent lamps, such, for example, as lamps containing an argon-nitrogen fill, and tungsten-halogen lamps containing a halogen other than fluorine.

The gas fill for the closed environment is preferably a mixture of an inert gas, such as nitrogen, and up to about 50% $WF_6$.

The above process is especially effective on filaments designed to operate at sufficiently high loading, for example, in which the ratio of lumens per watt to the natural log of lamp wattage is at least equal to 3.8.

Employment of this process thus provides the benefits of the fluorine cycle on initial filament repair while allowing the sale to the public of lamps which do not contain fluorine.

While there have been described what are at present considered to be the preferred embodiments of the invention, it will be apparent to those skilled in the art that various changes and modifications can be made herein without departing from the scope of the invention as defined by the appended claims.

I claim:

1. In a method of increasing the life of tungsten filaments employed as a light emitting element in a lamp, the steps comprising:

forming a filament from a length of tungsten wire;

placing said filament in a closed environment;

providing said closed environment with a non-hydrogen containing gas fill which includes tungsten fluoride;

applying sufficient electrical energy to said filament to cause hot spots on said filament to incandesce;

maintaining said hot spots on said filament at incandescence for a sufficient period of time to substantially remove said hot spots from said filament;

withdrawing said electrical energy and removing said filament from said closed environment; and subsequently operatively sealing said filament in a lamp envelope having a fluoride-free atmosphere.

2. The method of claim 1 wherein said gas fill includes also nitrogen.

3. The method of claim 2 wherein said gas fill comprises up to about 50% tungsten fluoride.

4. The method of claim 1 wherein said lamp envelope contains a substantial vacuum.

5. The method of claim 1 wherein said lamp envelope contains an inert gas.

6. The method of claim 1 wherein said lamp envelope contains a halogen selected from chlorine, bromine and iodine.

* * * * *